United States Patent [19]

Miura et al.

[11] 4,009,747

[45] Mar. 1, 1977

[54] METHOD OF AND DEVICE FOR FORMING VACUUM SEALED MOLDS

[75] Inventors: Takashi Miura; Hideto Terada; Takao Inoue; Hironobu Kubota, all of Toyokawa, Japan

[73] Assignee: Sintokogio, Ltd., Nagoya, Japan

[22] Filed: Mar. 12, 1975

[21] Appl. No.: 557,452

[30] Foreign Application Priority Data

Mar. 16, 1974 Japan ..... 49-30216
Apr. 25, 1974 Japan ..... 49-47029

[52] U.S. Cl. ..... 164/7; 164/160
[51] Int. Cl.[2] ..... B22C 5/12
[58] Field of Search ..... 164/7, 160

[56] References Cited

UNITED STATES PATENTS

| | | | |
|---|---|---|---|
| 2,513,785 | 7/1950 | Browne | 164/7 X |
| 3,825,058 | 7/1974 | Miuro et al. | 164/7 X |
| 3,843,301 | 10/1974 | Hijikata et al. | 164/160 X |

FOREIGN PATENTS OR APPLICATIONS

| | | | |
|---|---|---|---|
| 44-24082 | 10/1969 | Japan | 164/361 |
| 24,845 | 10/1912 | United Kingdom | 164/7 |

*Primary Examiner*—John E. Roethel
*Attorney, Agent, or Firm*—Armstrong, Nikaido & Wegner

[57] ABSTRACT

A method of and device for forming vacuum sealed molds, in which suction is applied to a charging material charged into a flask to remove the charging material adjacent the top of a sprue or a communicating passage thereby forming a cup-shaped pouring basin for the sprue or a funnel-shaped concave for the passage in a mold, thereafter a shielding film is applied over the upper surface of the flask, and a suction is applied to the charging material within the flask.

11 Claims, 8 Drawing Figures

METHOD OF AND DEVICE FOR FORMING VACUUM SEALED MOLDS

BACKGROUND OF THE INVENTION

1. Field of the Invention

The present invention relates generally to a method of and device for forming a vacuum sealed mold by assembling a pattern plate covered with a film with a molding flask, charging a heat-resisting particulate material into the flask, thereafter applying a shielding film over the upper surface of the flask, and reducing the pressure within the flask.

2. Description of the Prior Art

In the mold forming method of the type described, a sprue rod formed integral with a portion defining a pouring basin is made of a material such as foamed polystyrene, and is attached to a pattern or pattern plate covered with a film, so that a sprue and a pouring basin may be formed concurrently when a mold is formed. Alternatively, a conventional sprue rod wrapped with a film is attached to a pattern or pattern plate with an adhesive tape, and is removed after a mold is formed to form a sprue. Thereafter, an independent pouring basin is placed and communicated with the sprue. The former method is disadvantageous from the economical point of view because a sprue rod with a pouring basin forming pattern must be made of a material for each mold and when pouring molten metal, the sprue rod generates a lot of gas, so that it interfers the metal flow into the mold cavity. The latter method has also a disadvantage that the mold forming process becomes complicated because of the additional steps of wrapping film around a sprue rod, withdrawing the sprue rod upward, and placing a pouring basin.

SUMMARY OF THE INVENTION

The present invention was made in order to overcome the above disadvantages encountered in the conventional mold forming methods.

Furthermore, it has been already disclosed in the specifications of U.S. Pat. No. 3,825,058 and West German Laid-Open application No. 2,318,850 that in a vacuum sealed mold the provision of a communicating passage in communication with atmosphere outside the mold at the top of a cavity is indispensable in practice. The present invention was made to solve an existing problem encountered in formation of such communicating passage in the mold.

One of the objects of the present invention is to provide a method of and device for forming vacuum sealed molds, which is capable of simultaneously forming a sprue and/or a communicating passage in a simple manner.

DESCRIPTION OF THE PREFERRED EMBODIMENTS

First Embodiment, FIGS. 1 through 4

Figure 1:
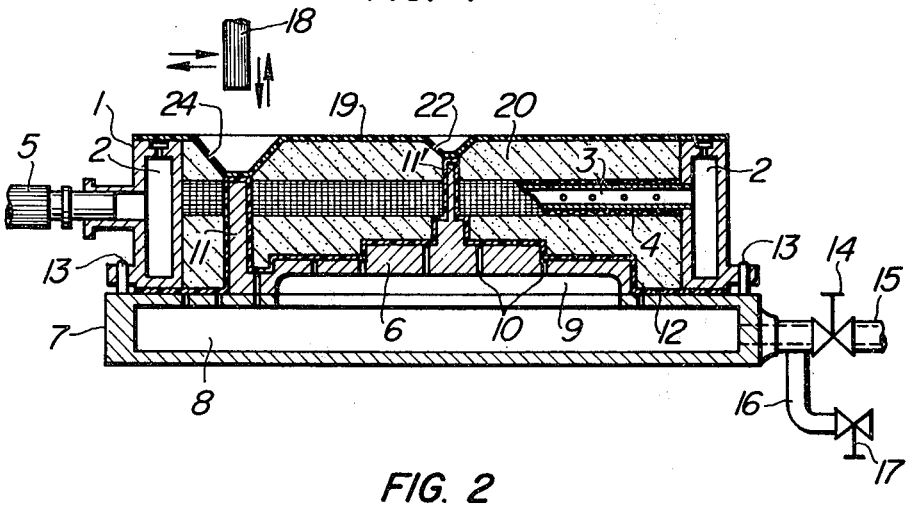
FIG. 1 is a sectional view of a first embodiment of the present invention.
Figure 2:
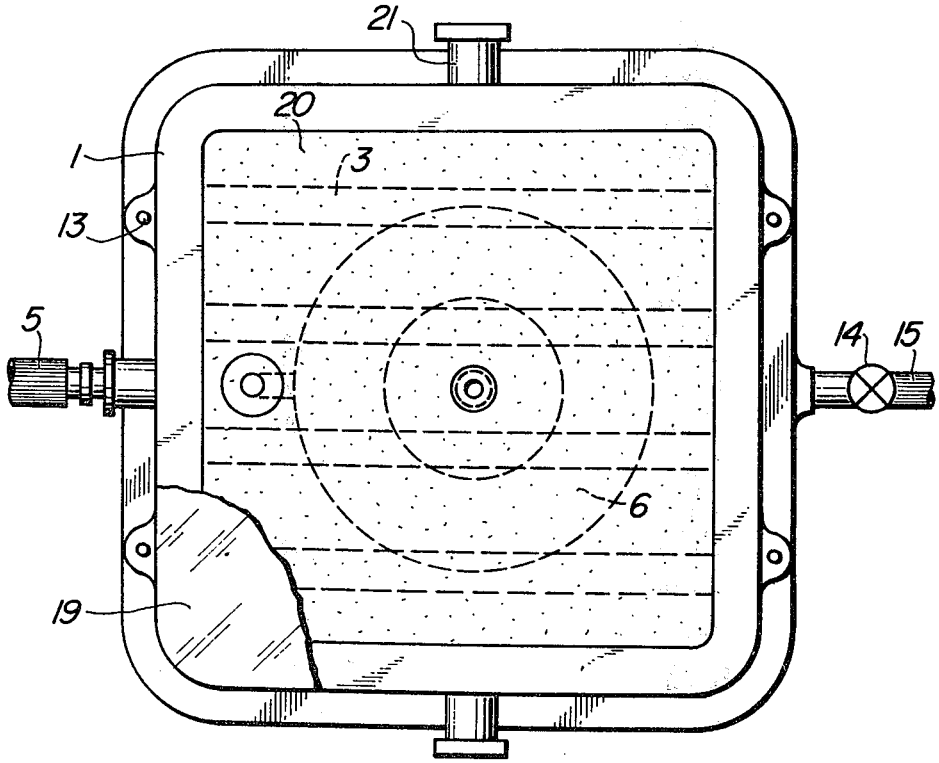
FIG. 2 is a top view thereof.

Referring to FIGS. 1 through 4, the first embodiment of the present invention will be described. A molding flask 1 is provided with a negative pressure chamber 2 communicated through a rubber hose 5 with a vacuum source (not shown). A plurality of apertured tubes 3 which are covered with a filter member 4 such as wire gauze are extended within the mold flask 1 transversely thereof and are communicated at both ends with the negative pressure chamber 2. A pattern table 7 formed integral with a pattern 6 has a negative pressure chamber 8 and an upper or pattern chamber 9 in communication with the former. A plurality of holes 10 with a small diameter are formed through the pattern 6 with the lower ends communicated with the upper chamber 9 and the upper ends opened at the surface of the pattern 6. Rods 11 and 11′ are formed integral with the pattern 6 at a suitable portion thereof in order to form a sprue and a communicating passage, respectively. The tops of the rods 11 and 11′ are slightly lower than the upper side of the molding flask 1. A film 12 of a suitable synthetic resin which is melted when molten metal is poured into a mold cavity is applied or coated over the whole surfaces of the pattern 6, the pattern plate 7 and the rods 11 and 11′. The molding pattern plate 7 has locating pins 13, and has its negative pressure chamber 8 communicated with a negative pressure line 15 which in turn is communicated through a valve 14 with a vacuum source (not shown) and with a bypass line 16 provided with a stop valve 17.

A suction pipe 18 which is so arranged as to be both vertically and horizontally movable as indicated by the arrows above the molding flask 1 is communicated through a hose (not shown) and a dust collector (also not shown) with a vacuum source (not shown). After heat-resisting particulate material 20 such as dried sand have been filled into the molding flask 1, a shielding film 19 is applied over the top surface of the molding flask 1. The interior of the molding flask 1 is communicated with the surrounding atmosphere through a part of the communicating passage 22, and the molding flask 1 has trunions 21 attached to the opposed side walls thereof.

Figure 3:
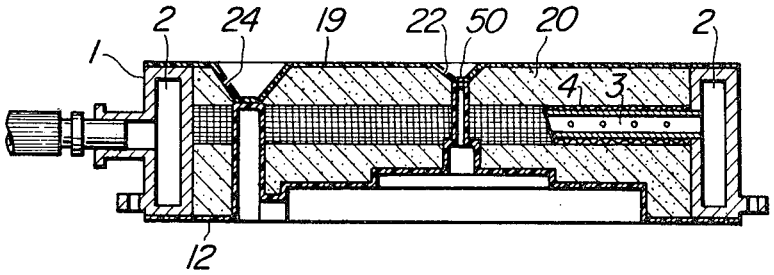
FIG. 3 is a sectional view of a mold formed by the first embodiment of the present invention.

Next the method of forming a mold by the molding device with the above construction will be described. After the sheet film 12 is applied over the pattern plate 7, the negative pressure chamber 8 thereof is communicated with the vacuum source so that the film 12 is made into intimate contact with the outer surfaces of the pattern 6, the pattern plate 7 and the rods 11 and 11′. Thereafter the molding flask 1 is placed in correct position on the pattern plate 7 with the aid of the locating pins 13, and then the particulate material 20 is charged into the molding flask 1. The vibrator (not shown) is energized to compact the particulate material 20 in the flask 1 until a desired compacting degree is attained. Thereafter the suction pipe 18 is communicated with the vacuum source and is lowered toward the surface of the particulate material 20 in the flask 1 immediately above the rod 11. Therefore the particulate material 20 above the rod 11 is gradually sucked through the suction pipe 18 so that a cup-shaped recess 24 with a rest angle which is dependent upon the particulate material 20 may be formed as shown in FIG. 1 and the film 12 at the top of the sprue rod 11 may be exposed. Thereafter the shielding film 19 is applied to cover the flask 1 and the particulate material 20, and then the negative pressure chamber 2 in the flask 1 is communicated with the vacuum source so that the negative pressure is exerted through the apertured pipes 3 to the charged particulate material 20. Therefore the film 12 as well as the shielding film 19 are firmly pressed against the particulate material 20, and the shielding film 19 is gradually deformed to make intimate contact with the side wall of the funnel-shaped recess 24, whereby the pouring basin may be formed. Next the negative pressure chamber 8 of a pattern plate 7 is communicated with the surrounding atmosphere so that the pattern plate 7 may be moved away from the film 12. Thus a mold as shown in FIG. 3 is formed. A recess for a communicating passage 22 may be formed in a manner substantially similar to the recess 24 for the pouring basin, i.e., by removing the particulate material 20 adjacent the top of the rod 11' by suction through the hose 18.

Figure 4:
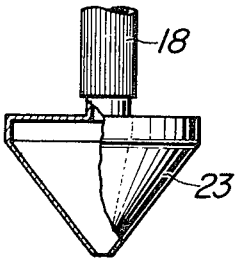
FIG. 4 is a side view, partly broken, of a variation of a suction pipe used in the first embodiment.
Figure 5:
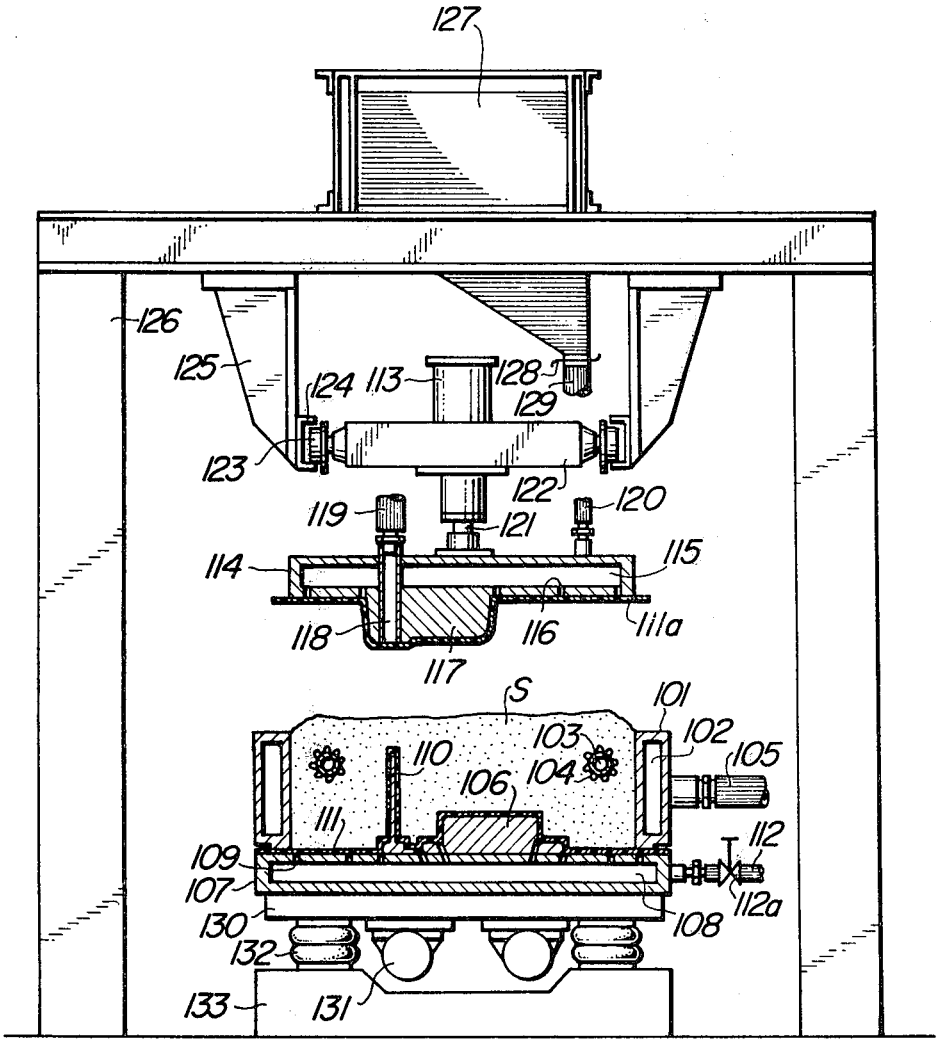
FIG. 5 is a sectional view of a second embodiment of the present invention.

As shown in FIG. 4, a conical shaped suction head 23 may be attached to the suction pipe 18. In operation of the vertex of the conical head 23 is made into contact with the surface of the charged particulate material 20, and then communicated with the vacuum source. Therefore the particulate material 20 is sucked into the conical suction head 23, and the funnel-shaped recess 24 for the pouring basin and the funnel-shaped recess 22 for the communicating passage are formed as the suction head 23 is gradually lowered towards the tops of the rods 11 and 11'.

As shown in FIG. 3, the hole 50 must be formed by a needle-like tool for communicating the interior of the cavity with the atmosphere. It is unnecessary to provide any hole in the pouring basin, because when the molten metal is poured into the pouring basin, the portions of the films 19 and 12 which are overlapped each other are naturally melted under the influence of heat of the molten metal, whereby a communicating aperture is formed.

Second Embodiment, FIGS. 5 through 8

Next referring to FIGS. 5 through 8, the second embodiment of the present invention will be described. A molding flask 101 of the second embodiment is substantially similar in construction to the first embodiment shown in FIG. 1. It has a negative pressure chamber 102 communicated through a rubber hose 105 with a vacuum source (not shown). A plurality of apertured pipes 103 surrounded by filter members 104 are arrayed within the molding flask 101 transversely thereof and are communicated with the negative pressure chamber 102. A pattern plate 107 formed integral with a pattern 106 has a negative pressure chamber 108, and a plurality of holes 109 with a small diameter are formed through the pattern 106 with the upper ends opened at the surface thereof and the lower ends communicated with the negative pressure chamber 108. A rod 110 for forming a sprue is formed integral with the pattern 106, and its top is located slightly lower than the upper surface of the molding flask 101. A film 111 is applied or coated over the surfaces of the pattern 106, pattern plate 107 and rod 110. The negative pressure chamber 108 of the pattern plate 107 is communicated through a valve **112*a* and a pipe 112** with a vacuum source (not shown).

A suction head generally indicated by 114 is raised or lowered by a cylinder 113 above the molding flask 101. The suction head 114 has a pouring basin forming pattern 117 formed integral with the undersurface thereof, and a negative pressure chamber 115. A plurality of holes 116 with a small diameter are formed through the bottom wall of the suction head 114 with their upper ends in communication with the negative pressure chamber 115 and their lower ends opened at the undersurface of the head 114.

A suction pipe 118 extended through the suction head 114 and its pouring basin forming pattern 117 has an inner diameter slightly larger than the outer diameter of the rod 110 so that the former may be fitted over the latter when the suction head 114 is lowered. The suction pipe 118 is communicated through a hose 119 and a dust collector (not shown) with a vacuum source (not shown). The negative pressure chamber 115 in the suction head 114 is also communicated through a hose 120 with a vacuum source (not shown).

The cylinder 113 is mounted upon a carriage 122 with wheels 123 riding on rails 124 supported by brackets 125 which in turn are securely attached to a beam or the like of a hopper supporting structure 126. A particulate material charging hopper 127 is mounted upon the supporting structure 126 so that the particulate material S stored therein may be charged through a gate 128 and a hose 129 into the molding flask 101.

The pattern plate 107 is supported upon a vibrator table 130 attached to vibrators 131 and supported through air cushions 132 upon a base 133.

Figure 6:
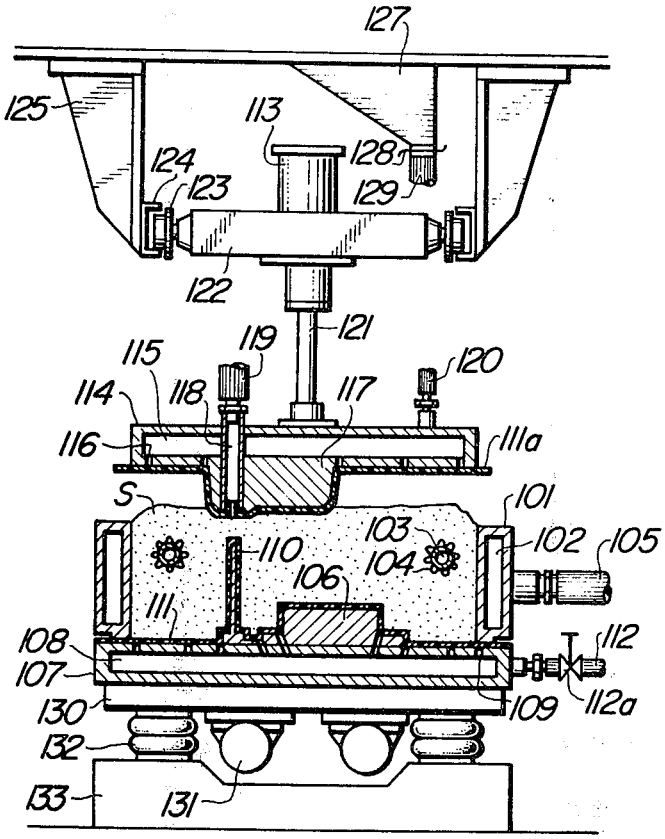
FIGS. 6 and 7 are views similar to FIG. 5, but illustrating the steps, respectively, of the molding forming process in accordance with the second embodiment.
Figure 7:
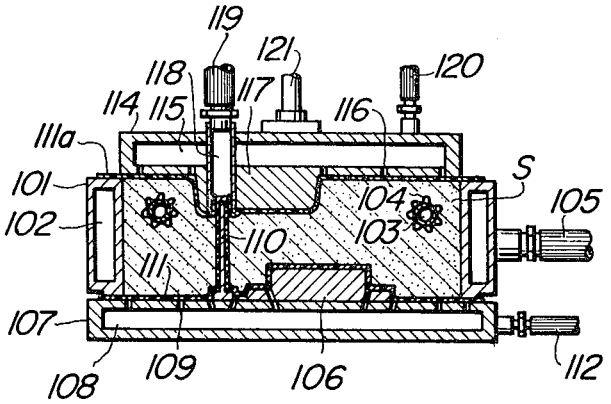
Figure 8:
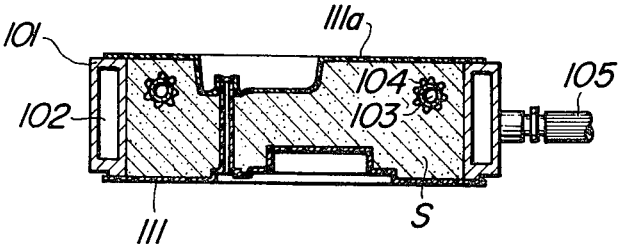
FIG. 8 is a sectional view of a mold formed by the second embodiment of the present invention.

Next the operation of the molding device with the above construction will be described hereinafter. After the film 111 is applied over the pattern plate 107, the negative pressure chamber 108 thereof is communicated with the vacuum source so that the film 111 may be made very intimate contact with the outer surfaces of the pattern 106, pattern plate 107 and rod 110. Thereafter the molding flask 101 is placed on the pattern plate 107, and the gate 128 of the hopper 127 is opened so as to charge the particulate material S into the molding flask 101. Thereafter the vibrators 131 are actuated until a desired compacting degree is attained. The shielding film **111*a* is applied over the undersurface of the suction head 114, and then the negative pressure chamber 115 is communicated with the vacuum source so that the shielding film 111*a* may be made into very intimate contact with the undersurface. Thereafter the carriage 122 is moved along the rails 124 to the position immediately above the molding flask 101. Next the cylinder 113 is actuated or extended as shown in FIG. 6 so that the undersurface of the pouring basin forming pattern 117 may be made into contact with the upper surface of the particulate material S in flask 101. Thereafter, the suction pipe 118 is communicated with the vacuum source so that the shielding film 111*a* immediately below the suction pipe 118 is broken or ruptured. Therefore, the air flows along the surface of the pouring basin forming pattern 117 entraining the particulate material S into the suction pipe 118. Therefore, as the suction head 114 is gradually lowered, part of the particulate material S is removed and discharged through the suction pipe 118 so that the pouring basing forming pattern 117 may be gradually embedded into the particulate material S in the molding flask 101. When the lower end of the suction pipe 118 contacts with the upper end of the rod 110, the suction pipe 118 is disconnected from the vacuum source, and concurrently the lowering of the suction head 114 and hence the pattern 117 is interrupted as shown in FIG. 7. Thereafter the negative pressure chambers 108 in the pattern plate 107 and 115 in the suction head 114 are disconnected from the vacuum sources while the negative pressure chamber 102 in the molding flask 101 is communicated with the vacuum chamber. The particulate material S is subjected to the negative pressure through the apertured pipes 103 so that the film 111 and the shielding film 111***a* are forced into intimate contact with the lower and upper surfaces of the particulate material in the molding flask 101. The shielding film 111*a* is also forced into intimate contact with the surface of the cup-shaped recess formed by the pouring basin forming pattern 117 so that the cup-shaped pouring basin may be defined. The bottom of the cup-shaped pouring basin is made into contact with the top of the rod 110 with the shielding film 111*a* and the film 111, and a mold cavity corresponding to the pattern 106 is formed at the bottom of the particulate material in the flask 101. Thereafter the suction head 114 is raised away from the shielding film 111 while the pattern plate 107 is lowered away from the film 111 so that the mold may be formed as shown in FIG. 8. A communicating passage may be formed in a similar manner.

As described above, according to the present invention, molds with a sprue or a communicating passage may be formed in a simple yet quick and reliable manner, and the use of a sprue rod made of a material such as foamed polystyrene and an independent pouring basin made of heat resisting material in the conventional molding methods and devices may be eliminated. Moreover, laborious operation of removing the independent pouring basin from the mold after the molten metal is poured into the mold may be eliminated. Thus the present invention may attain considerable operational and economical efficiency in foundries.

What is claimed is:

1. A method of forming vacuum sealed molds comprising the steps of a. applying a first film over the surface of a pattern plate including a pattern for forming a mold cavity and at least one rod member integral therewith for forming a sprue or a communicating passage;

b. assembling said pattern plate with a molding flask provided with means for reducing the pressure therein;

c. charging a particulate material into the flask;

d. forming a cup-shaped pouring basin in said charged material by removing part of the charged material immediately above the rod member by vacuum suction until the top of said rod member covered with the film is exposed to form said cup-shaped pouring basin in the particulate material;

e. applying a shielding film over said flask and the upper surface of the charged material whereby said material covers said cup-shaped pouring basin;

f. forcing said first film and the shielding film into intimate contact with the lower and the upper surfaces of the charged material respectively by creating a negative pressure in the flask with said pressure reducing means whereby said shielding film is brought into contact with the first film at the top of said rod member; and g. removing the pattern plate from said first film.

2. A method as claimed in claim 1, wherein the steps of removing part of the charged material and applying a shield film comprise the steps of applying the shielding film over a pattern provided with a cup-shaped convex portion in a position corresponding to said cup-shaped pouring basin and with a suction pipe for removing part of the charged material, and making the shielding film into contact with the upper surface of the charged material in the flask while removing part of the charged material immediately above said rod member through an opening formed in the shielding film covering the open end of said pipe by rendering negative pressure forcedly therethrough.

3. In a mold forming device comprising:

a. a pattern plate including a pattern with at least one rod member for forming a sprue or communicating passage;

b. a molding flask mounted on said pattern plate; and c. particulate material charged into an open topped chamber defined by said pattern plate and said molding flask; the improvement comprising:

d. sucking means positioned above the upper surface of the charged material for removing the particulate material adjacent the free end of said rod member to form a cup-shaped pouring basin in the charged material above the free end of said rod member; and e. shielding film applying means, above the upper surface of the charged material, for applying a shielding film over the upper surface of said charged material with said cup-shaped pouring basin therein.

4. A device as claimed in claim 3, wherein said shielding film applying means includes a sucking plate provided with a cup-shaped convex portion in a position corresponding to said rod member and with sucking apertures for applying suction pressure to said shielding film to cover the cup-shaped convex portion with the shielding film; and motion means for causing a relative movement of said sucking plate with respect to said flask.

5. A device as claimed in claim 4, wherein said sucking means comprises a suction pipe opening at the surface of said convex portion of said sucking plate.

6. A device as claimed in claim 5, wherein said suction pipe has its inner diameter larger than the outer diameter of said rod member such that said rod member covered with the film may be inserted into said suction pipe when said shielding film applying means applies said film over said charged material.

7. A device as claimed in claim 4, wherein said device further includes a carriage for horizontally carrying said sucking plate for moving the sucking plate towards and away from a mold-forming station where the molds are formed.

8. A device as claimed in claim 4, wherein said motion means includes a piston and cylinder.

9. A device as claimed in claim 4, wherein said device further includes a vibrator adapted to support the pattern plate and provided in said mold-forming station, a hopper through which said particulate material is charged into the flask and a carriage for moving towards and away from said mold-forming station, said motion means comprising a piston and cylinder mounted on said carriage.

10. In a mold forming device comprising:

a. a pattern plate including a pattern with at least one rod member for forming a sprue or communicating passage;

b. a molding flask mounted on said pattern plate; and c. particulate material charged into an open topped chamber defined by said pattern plate and said molding flask; the improvement comprising:

d. sucking means positioned above the upper surface of the charged material for removing the particulate material adjacent the free end of said rod member to form a cup-shaped pouring basin in the charged material above the free end of said rod member.

11. A device as claimed in claim 10, wherein said sucking means comprises a substantially funnel-shaped hollow member in the form corresponding to the cup-shaped pouring basin, a suction aperture provided at the apex of said funnel-shaped hollow member, and a suction pipe in communication with the interior of said hollow member.

* * * * *